US006012265A

United States Patent [19]

Ady

[11] Patent Number: 6,012,265

[45] Date of Patent: Jan. 11, 2000

[54] APPARATUS FOR QUICK EVACUATING AND CLOSING LIDDED JARS AND VESSELS CONTAINING FOODSTUFF AND OTHER PRODUCTS

[76] Inventor: Roni (Aharon) Ady, Haifa, Israel

[21] Appl. No.: 09/004,436

[22] Filed: Jan. 8, 1998

Related U.S. Application Data

[63] Continuation-in-part of application No. 08/847,043, May 1, 1997, abandoned.

[51] Int. Cl.[7] ..... B65B 31/00

[52] U.S. Cl. ..... 53/103; 53/84; 53/86; 53/510; 141/DIG. 1

[58] Field of Search ..... 53/510, 511, 512, 53/84, 86, 103; 141/7, 8, DIG. 1

[56] References Cited

U.S. PATENT DOCUMENTS

| | | | |
|---|---|---|---|
| 1,556,981 | 10/1925 | Voight | 141/65 |
| 1,594,512 | 8/1926 | Von der Lippe-Lipski | 53/103 |
| 1,598,089 | 8/1926 | Langkopf | 141/65 |
| 2,657,847 | 11/1953 | Heitmann | 53/98 |
| 4,154,044 | 5/1979 | Lang | 53/510 |
| 4,372,096 | 2/1983 | Baum | 53/103 |
| 4,478,025 | 10/1984 | Scanlan | 53/512 |
| 4,744,199 | 5/1988 | Gannon | 53/434 |
| 4,909,014 | 3/1990 | Kobayashi | 53/86 |
| 5,121,590 | 6/1992 | Scanlan | 53/510 |
| 5,239,808 | 8/1993 | Wells et al. | 73/105 |
| 5,474,115 | 12/1995 | Fink, Jr. | 141/DIG. 1 |
| 5,528,880 | 6/1996 | Landolt | 53/432 |
| 5,562,133 | 10/1996 | Mitchell | 141/DIG. 1 |
| 5,732,535 | 3/1998 | Mitsuta | 53/512 |

OTHER PUBLICATIONS

Brochure entitled "Vacumizer", three pages, published prior to May, 1997.

*Primary Examiner*—Peter Vo
*Assistant Examiner*—Matthew Luby
*Attorney, Agent, or Firm*—Frishauf, Holtz, Goodman, Langer & Chick, P.C.

[57] ABSTRACT

A portable vacuum apparatus comprises a vacuum chamber to be filled with lidded jars, bottles or other containers containing foodstuff or other products for the purpose of storing the contents under vacuum. The vacuum chamber is composed of a platform covered by a layer of a resilient material serving as a seal, and of a removable cover seated on the platform. The chamber is pipe-connected to an electrically operated vacuum pump and to an automatic valve connecting the chamber with the atmosphere in open state. To evacuate the chamber and the jars the valve is manually closed and the pump is started exhausting air from the chamber and the jars. The valve is adapted to open automatically as soon as the required vacuum has been reached and to interrupt the electric supply to the pump motor. The valve is designed to open a wide passageway to the chamber causing the air to rush in and to create a shock wave. The lids on the jars and containers are of the conventional kind provided with gaskets and are slightly lifted off their seats during evacuation and are firmly pressed onto the openings of the jars by this shock and thus closed under vacuum conditions.

19 Claims, 5 Drawing Sheets

APPARATUS FOR QUICK EVACUATING AND CLOSING LIDDED JARS AND VESSELS CONTAINING FOODSTUFF AND OTHER PRODUCTS

This application is a Continuation-In-Part of Ser. No. 08/847,043, now abandoned filed May 1, 1997, the entire contents of which are incorporated herein by reference.

The invention relates to a method and apparatus for storing foodstuff and other products by enclosing them in jars or other containers, evacuating the air to a certain degree and automatically closing them to maintain the vacuum. The invention relates particularly to a portable unit to be used in the kitchen or the laboratory.

BACKGROUND OF THE INVENTION

It is a known fact that perishable goods can be kept for longer periods while in a clean atmosphere containing a minimum of oxygen and humidity. Food exposed to the influence of oxygen and humidity quickly loses its taste, flavor and texture. For this reason preserves are packed in a vacuum, as well as granular foods which are packed in an airtight package. These preserves and packages are manufactured under vacuum. In fact, many chemicals, especially pharmaceutics, are nowadays preserved from the influence of humidity and oxygen, by keeping them enclosed in vacuumized containers, or in containers filled with nitrogen.

In the old times most households had an apparatus for preparing preserves of fruit and vegetables. This apparatus was in the form of a large pot closed by a cover and partly filled with water. A number of glass jars with gasketed covers filled with fruit or vegetables with a certain amount of water were placed into that pot which was then brought to boiling. The water in the jars created steam and after cooling the vacuum created in each jar sucked the cover tightly onto the opening and the food was thus preserved for a long period of time.

A later development of an evacuating system included containers provided with a check-valve and a tube connector in the lid or cover. Air was pumped out by a manually or mechanically operated pump connected to the container by a flexible hose. This practice never found many friends because of the time required for evacuating every container separately, the cost of the valve and the danger of pollution by way of the valve.

With increasing industrialization these apparatus were stored away and home-made preserves disappeared from the dinner table. The main reason was the time and effort required in making these preserves, while the supermarket could supply the desired—or a similar—product in a tin. Not only is the home-made product of higher quality, since it used to be made of selected fruits and vegetables, but it used to be prepared to the family's taste, while tinned food is not always of first choice, not to mention its higher price.

For these reasons it is the object of the present invention to provide a domestic apparatus capable of preparing preserves in a matter of seconds with a minimum of effort It is another object to provide a domestic apparatus for making preserves of any foodstuff or product, either in raw state or precooked.

It is a foremost object to preserve food in jars or other containers to be closed by a simple cover or screwcap without any special checkvalves.

Still another object is to provide a domestic apparatus which is operable by anybody, without danger of being scalded by steam or boiling water.

It is an additional object of the invention to use for storage of foodstuff and other products any kind of vessel, jar, bottle or container that can be closed by any kind of lid or cover provided with a gasket to seal the opening of the vessel.

And it is a final object to provide the equipment at a price which will make it available for most households.

SUMMARY OF THE INVENTION

The method of preparing vacuumized jars and the like filled with perishable foodtuff comprises the steps of:

1) placing one or several jars into a chamber which can be hermetically closed and is connected to a vacuum pump; the jars and containers are covered each by a lid or srewcap which is loosely placed on the jar's open top;
2) closing the chamber and evacuating it together with the jars; while the initial atmospheric pressure in the jar lifts the lid and keeps it open as long as the space is being evacuated.
3) effecting instantaneous entry of outside air into the chamber by means of a valve which opens automatically and instantaneously at a predesignated vacuum pressure; this entry of air at atmospheric pressure results in a strong shock on the lids and presses them closely onto the jar openings;
4) opening the chamber and removing the jars and/or containers.

A preferred embodiment of the apparatus for carrying the method into effect includes a compartment containing the mechanical equipment, viz an electrically operated vacuum pump, an automatically opened valve, piping and auxiliary equipment for starting the operation, while this is stopped automatically as soon as a preselected degree of vacuum has been reached. In a first embodiment the compartment has a flat top which forms a platform serving to be covered by a cylindrical, hemispherical or bell-shaped cover adapted to withstand the pressure difference between vacuum and atmospheric pressure. The contact area between platform and cover is hermetically sealed by gasket means, attached either to the platform or to the cover. The platform and the cover form the vacuum chamber of the apparatus serving to have a number of product-filled containers or jars placed on the platfom, while they are loosely covered by lids or screwcaps. The platform is provided with a port connecting it to the vacuum pump by piping, and the delivery side of the pump is connected to the atmosphere. The platform, i.e. the chamber, is further connected to the atmosphere by the afore mentioned valve which is to be manually closed and opens automatically as soon as the desired vacuum has been reached. Manual closing of the valve closes a switch which actuates the vacuum pump, and opening of the valve stops the pump. After insertion of the jars the chamber is closed by placing the cover onto the platform and the valve is closed starting the vacuum pump simultaneously. As soon as the predesignated vacuum level has been reached, the valve opens automatically and the pump is stopped. The sudden entry of outside air into the chamber causes a pressure shock which closes the lids on the jars and containers hermetically by pressure difference caused by the atmosphere and the vauum in the container.

With screw-cap covers it may be advantageous to give them an addtional turn. The contents are now vacuum-protected and can be stored for lengthy periods with or without cooling.

A jar with a smooth opening may also be closed by placing a flat lid with a layer of rubber sheeting onto the opening which will be pressed onto it by atmospheric pressure.

The compartment containing the vacuum pump and accessories is preferably in the shape of a cylinder with its top forming the platform for placing thereon the jars or containers and for closing the vacuum chamber by placing the cover onto the platform. The chamber is made airtight by either covering the platform with a layer of a resilient material such as rubber sheeting or by placing a gasket into a recess along the lower rim of the cover. The cover is made of a solid, preferably but not necessarily, transparent material such as glass or acrylic, but similarly of a non-corrosive metal.

As an alternative the compartment may be rectangular, with the cover having a circular or elliptical base, always provided that it is built to withstand the pressure difference.

Still another embodiment of the apparatus includes a vacuum chamber spaced apart from the mechanical equipment and connected thereto by piping.

The valve may be held in closed position either mechanically or by a permanent or electrical magnet so designed that the force which retains the valve can be adapted to fit the required vacuum. It is also important that flow resistance of the valve and the piping leading to the chamber is as low as possible in order to have the outside air enter the chamber shock-like which will serve to close the lids on the jars.

PRIOR ART

With these objects in mind, some manufacturers supplied the housewife with special jars closed by screw caps, with each cap fitted with a check valve. They further supplied vacuum apparatus configured to evacuate the air from these jars which had been filled with foodstuff, with the object to store them for longer periods. One of these apparatus is being described in U.S. Pat. No. 4,909,014.

The apparatus includes a storage chamber composed of a base and a hemispherical, removable cover and a hand-operated bellow mounted on top of the cover. After insertion of a closed jar the cover had to be placed onto the base and the bellows had to be operated until the desired level of vacuum had been reached. The check valve opens owing to the subpressure and the air is partly evacuated from the jar. Now a valve has to be opened allowing air at ambient pressure to enter, whereby the check valve closes and keeps the jar and its contents at vacuum pressure.

Another hand-operated apparatus is disclosed in U.S. Pat. No. 1,556,981 which includes a bellows and two valves for opening and closing a vacuum chamber.

An apparatus for packaging goods in a plastics bag or in a container having a deformable lid is descibed in U.S. Pat. No. 4,744,199. He containers are placed into a vacuum chamber which is evacuaated causing the containers to be closed by flaps coated with adhesives by opening a valve to let outside air into the chamber.

Still another apparatus is described in U.S. Pat. No. 5,528,880 wherein an electronic sensor serves to open a valve to connect the vacuum chamber with the outside. This apparatus is used for evacuating and closing packages in a manner similar to that descibed in U.S. Pat. No. 4,744,199.

t An electrically operated apparatus is on the market and includes a vacuum pump which has its suction port attached to a checkvalve in the screwcap of a jar. Air is sucked of the jar, whereupon the check valve closes, the connection to the vacuum pump is lifted off the screwcap and the closed jar is removed for storage.

These special jars not only raise the cost of vacuum storage, but the check valves do not always ensure firm closure and are apt to let dirt or bacteria enter the jars. In addition the apparatus evacuates one jar each time, while the present apparatus serves for vacuumizing several jars simyltaneously.

Summing up, not one patent describes an apparatus for evacuating and closing lidded jars, which features a valve that opens automatically as soon as the required degree of vacuum has been reached and causes simultaneous stopping of the vacuum pump. And not one apparatus is adapted to create a shock wave that forces the lid onto the jar opening, also in the case of a screwcap.

DETAILED DESCRIPTION OF THE DRAWINGS

Figure 1A:
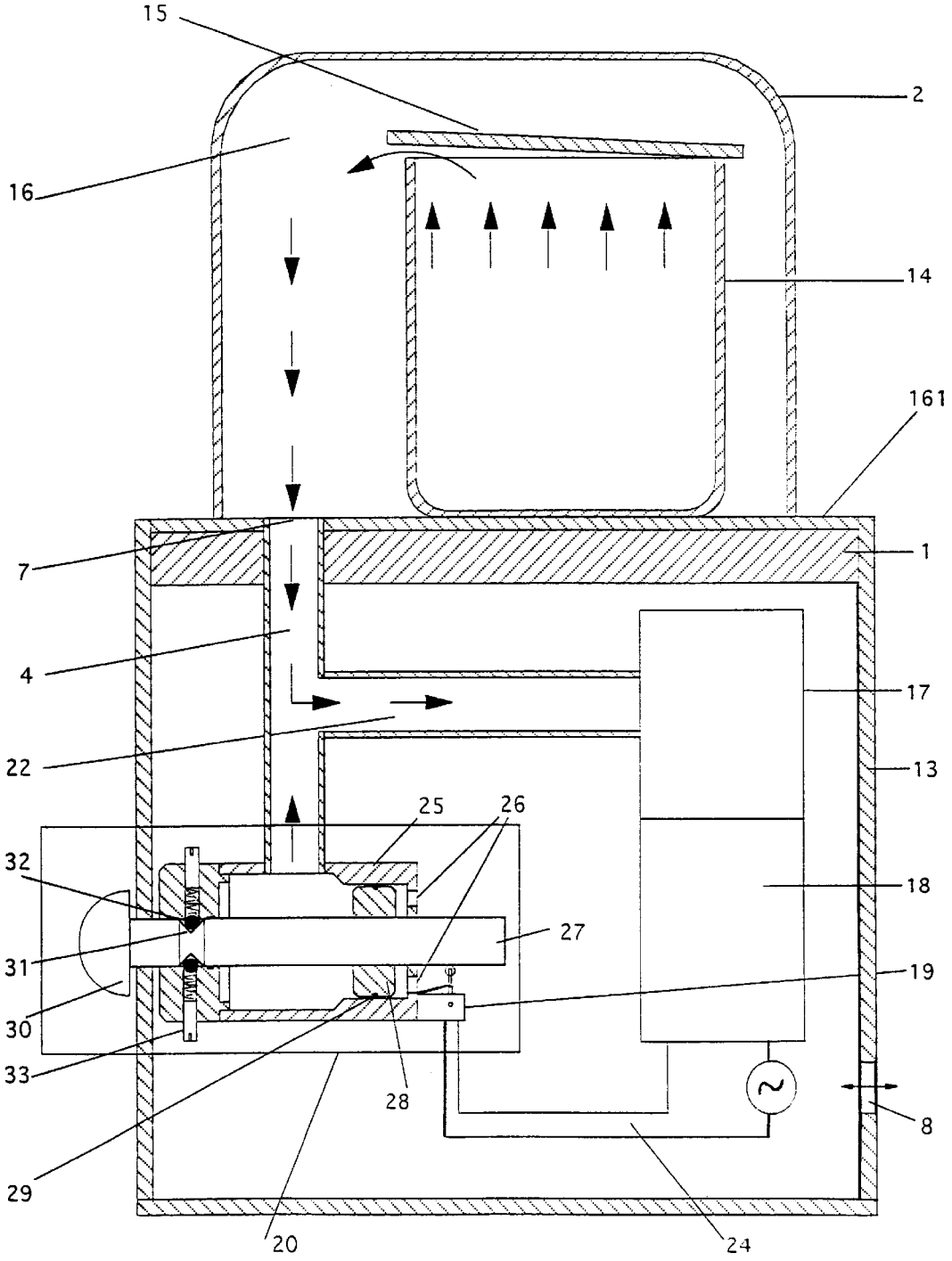
FIG. 1A show a schematic section of the vacuum apparatus during evacuation of a lidded jar and illustrates the lid-liftingg effect due to air sucked out of the jar.
Figure 1B:
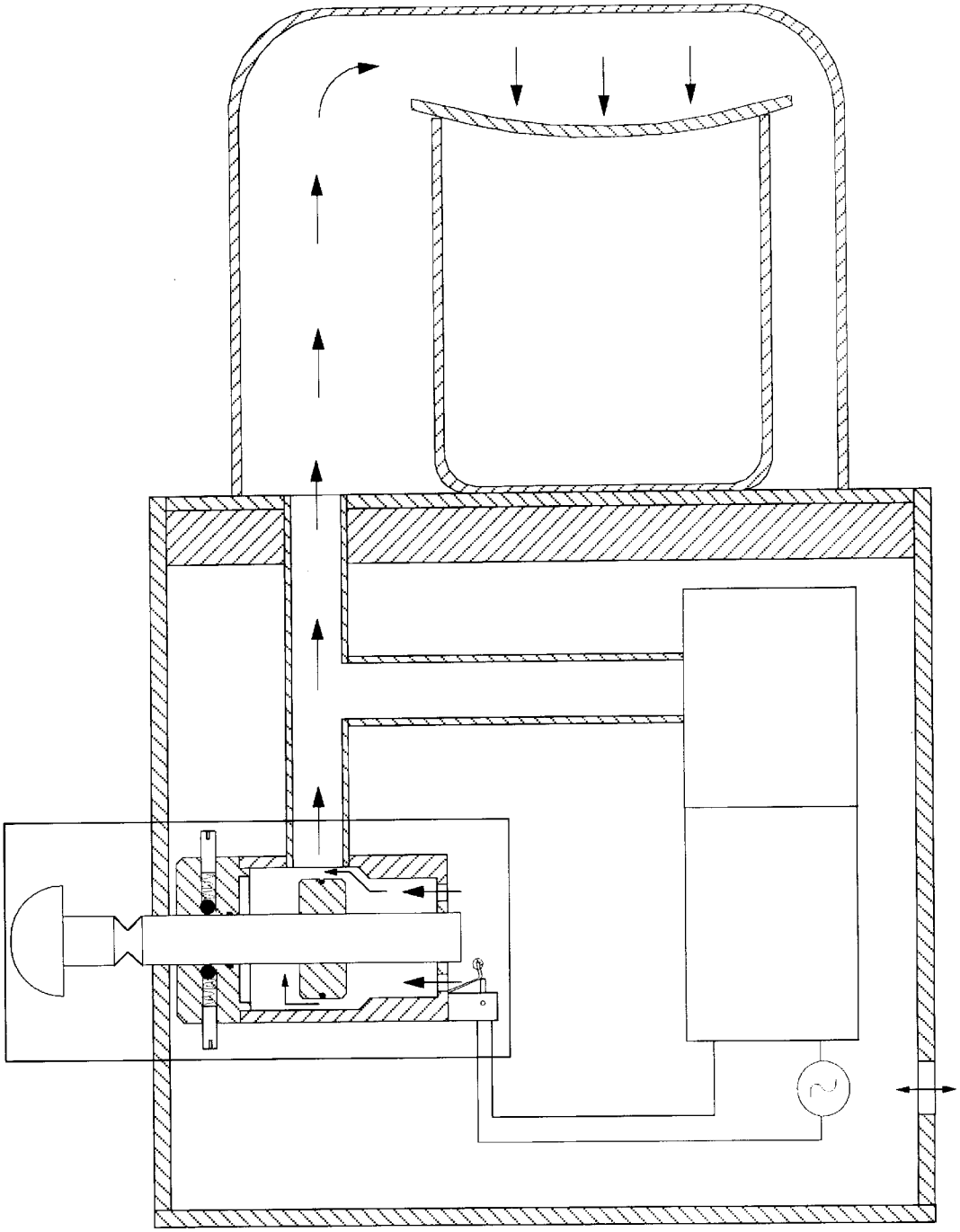
FIG. 1B shows the apparatus of FIG. 1 with the valve open and the lid pressed down by a shock wave.

FIG. 1*a* and 1*b* show the vacuum apparatus schematically and does not represent a true section of a working model, but its intention is to show its working. FIG. 1*a* showing it during evacuation of air, and FIG. 1*b* during entrance of outside air. There is shown a jar 14 covered by a flat lid 15 placed inside the vacuum chamber 16. The chamber is formed by a cylindrical cover 2 placed on platform 1 with a layer of a resilient material 161 on the platform serving as an airtight gasket. The platform constitutes the top of a cylindrical compartment 13 which contains a vacuum pump 17 driven by an electric motor 18. It further contains a quick-acting valve 20 which is connected to the chamber by a pipe 4 via a port 7 and to the atmosphere by aa large opening 8. in the wall of the compartment Pipe 4 is connected to vacuum pump 17 by a pipe 22, whereby pipe 4 acts both as suction and supply way. a micro=switch 19 is attached to the valve 20 and to motor 18 by wiring 24. Not shown is a connection to a domestic supply outlet.

The valve shown in FIG. 1 represents one embodiment of a plurality of valves suitable for the purpose of opening automatically at a predesignated vacuum level, but it is of very simple design and accordingly cheap. In FIG. 1*a* it is shown in closed state while the vacuum chamber is evacuated as shown by arrows. It includes, a casing 25 which is connected to pipe 4 and features air inlet openings 26. A valve disk 28 is firmly attached to a valve stem 27 which extends out of the casing and is shown to press on switch 19 actuating the pump motor 18. The valve disk closes the valve by means of an O-ring 29 by contact with the tubular valve seat while the stem is pushed in wardly by means of a knob 30. The stem is provided, close to knob 30, with a circumferential groove 31 into which two steel balls 32 are urged by springs and screws 33. This arrangement permits adjustment of the required resistance to the opening of the valve disk by pressure difference between atmospheric pressure inside the compartment and vacuum inside the valve casing. As soon as the disk has moved a few millimeters due to the pressure difference, the balls are moved out of the groove and cause almost no resistance to the further motion of the disk and the stem. The lid on the jar is shown to have one edge slightly lifted to allow the air to escape out of the jar.

FIG. 1*b* demonstrates the state of affairs a moment after the valve has been opened by the pressure difference and outside air rushing into the vacuum chamber.

The retreating valve stem has opened the micro-switch thereby stopping the vacuum pump. The shocklike entry of air has closed the lid onto the jar and the drawing shows it slightly pressed inwardly by atmospheric pressure. It should be noted that the valve is designed to open a wide passage permitting air to enter the vacuum chamber within a fraction of a second, thereby creating the afore mentioned shock.

Figure 2:
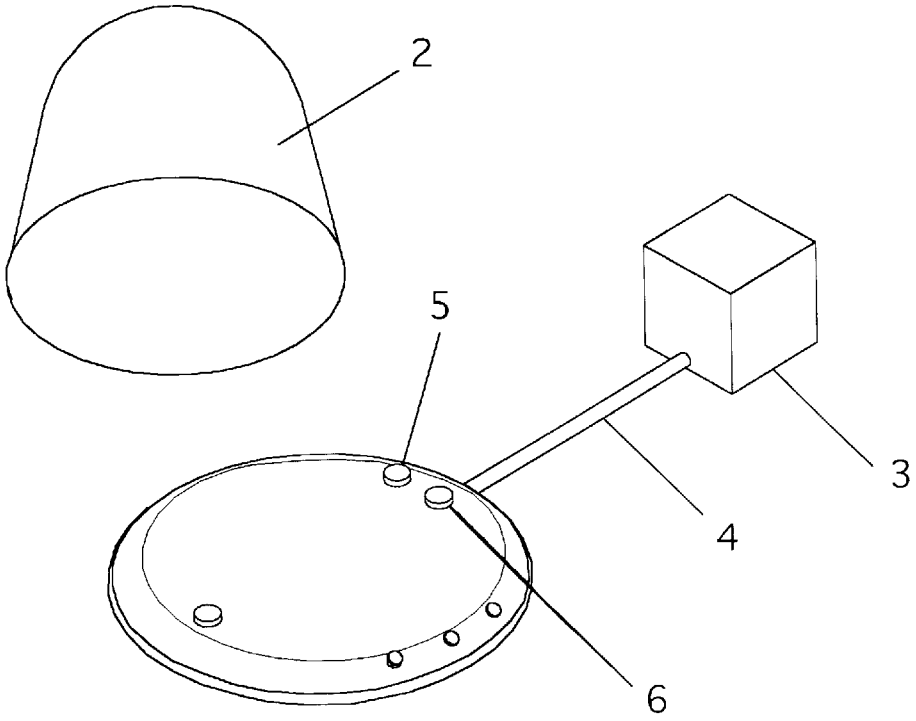
FIG. 2 illustrates a vacuum apparatus with separate vacuum chamber and vacuum pump equipment in opened state, FIG. 3 illustrtates the equipment of FIG. 2 in closed state.
Figure 3:
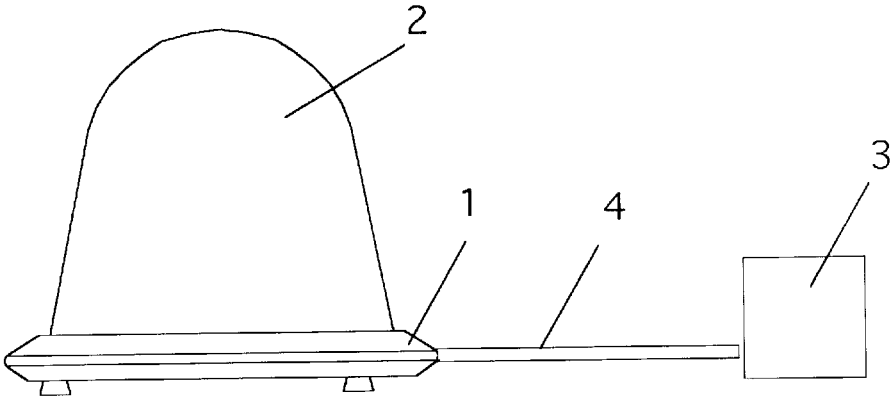

FIGS. 2 through 5 illustrate various embodiments of the apparatus without, however, showing any mechanical details:

FIGS. 2 and 3 illustrate a vacuum apparatus having separate vacuum chamber and vacuum pumping equipment, the latter contained in a box-shaped compartment 3. The chamber includes a circular platform 1 and a bell-shaped cover 2, shown separately in FIG. 2 and in assembled state in FIG. 3. Platform 1 is connected to compartment 3 by two pipes 4 which connect the chamber by means of ports 5 and 6 in the platform surface with equipment in compartment 3. One of the pipes connects the chamber with the suction port of the vacuum pump with the aim to exhausting the chamber. The second pipe connects the chamber to the automatic valve and to the controller configured to stop the pump motor and to open the valve.

Figure 4:
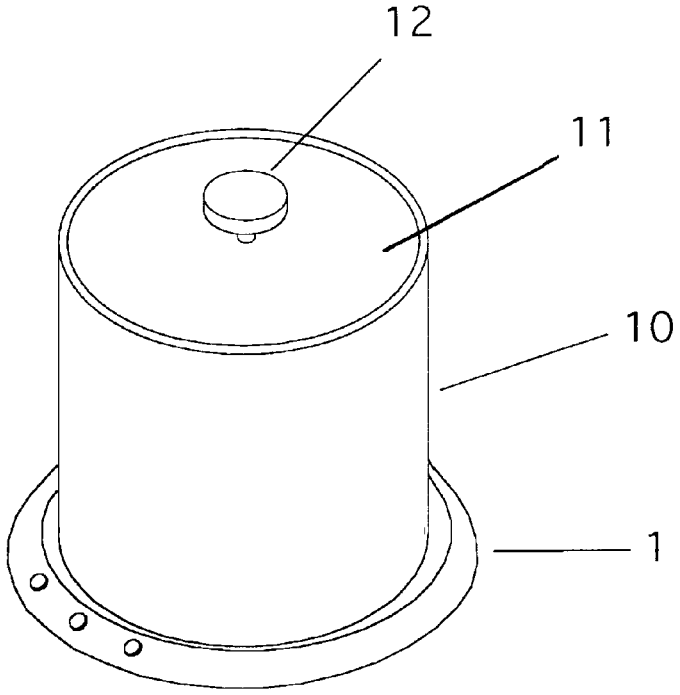
FIG. 4 illustrates a vacuum chamber in the shape of a platform and a cylindrical cover.

The vacuum chamber illustrtated in FIG. 4 is similar to that of FIGS. 2 and 3 except for the size and shape of the chamber cover. This cover consists of a cylindrical envelope 10 closed at the upper end by a flat disk 11 which is provided with a lifting knob 12. It is pointed out that disk 11 has to be made of thicker material in order to withstand the pressure difference. The advantage of the cylindrical cover is the possibility of inserting into the chamber jars or containers of larger height, a matter not easily obtainable with the afore described bell-shaped cover.

The chamber of FIG. 4 may illustrate an alternative embodiment, namely that the cylinder is firmly attached to the platform, while the top cover 11 is a separate unit and serves as a cover for the cylindrical envelope. Gasket means are provided either on the upper rim of the cylinder or on the lid or cover 11. Jars are to be placed into the cylindrical space via the open top and likewise withdrawn.

Figure 5:
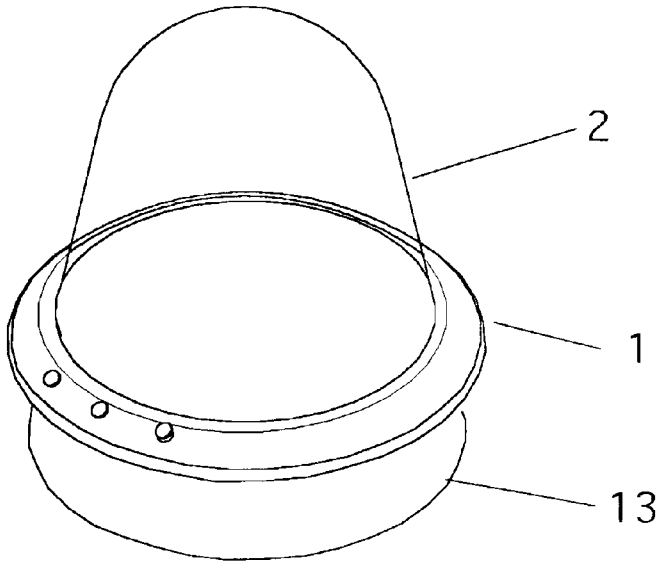
FIG. 5 illustrates a vacuum chamber mounted on a cylindrical compartment containing the vacuum pumping equipment.

A slightly different vacuum apparatus is illustrated in FIG. 5 which shows vacuum chamber and vacuum pumping compartment united in one compact unit. Herein platform 1 forms the top of a cylindrical compartment 13, while the chamber is formed by a bell-shaped cover 2 as in FIGS. 2 and 3.

In all embodiments the chamber is made airtight by gasket means between platform and cover, either by covering the entire platform surface with a layer of a resilient material such as rubber sheeting, or by means of a gasket inserted into a recess in the rim of the cover.

The units are portable and can be readily placed onto a suitable table or shelf in kitchen, pantry or laboratory, to be connected to the nearest wall outlet.

Figure 6A:
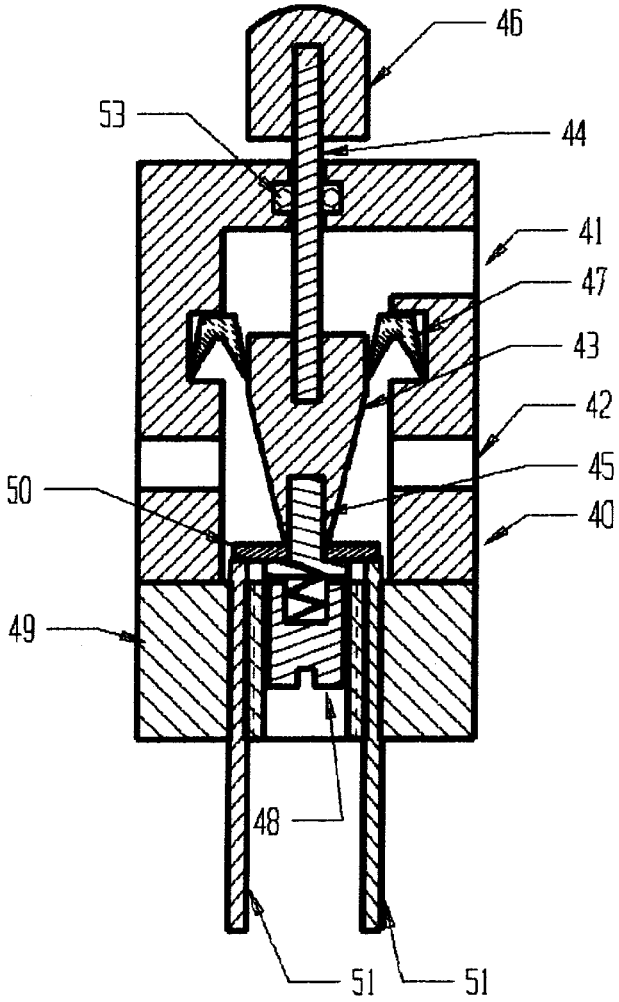
FIG. 6*a* illustrates a second embodiment of a valve and pump switch, in vacuum generating state.
Figure 6B:
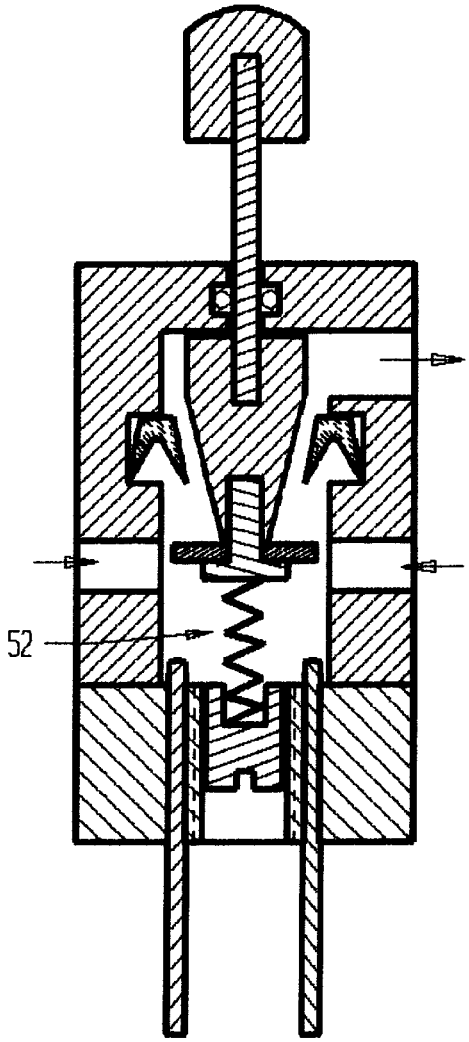
FIG. 6*b* illustrates the valve of FIG. 6*a* in open state.

An alternative valve is illustrated in FIGS. 6*a* and 6*b*, wherein the resistance to opening of the valve is by the force of a magnet. Referring now to FIG. 6*a*, the valve componennts are enclosed in a casing 40 which features a port 41 for connection to the vacuum chamber by piping and ports 42 open to atmospheric pressure. A valve body 43 has a cylindrical portion which is connected to a valve stem 44 and a conical portion which encloses a steel bolt 45. Both casing and valve body are of a non-conductive material, the valve being closed by contact of the cylindrical portion with a U-ring seal 47 of a flexible material. The passage of the stem through the casing is sealed by a shaft seal 53 preventing air from entering the casing. After having been pushed into closed position by a knob 46 the valve body is held there by means of a permanent magnet 48 attracting steel bolt 45. The magnet is of cylindrical shape and can be axially moved in a screw-threaded bore in an annular bottom part 49 of the casing, likewise of a non-conductive material. The magnet is thus shifted with the object of changing its distance from the steel bolt and adjusting the attracting force thereby. The steel bolt also holds a conductive disk 50 which, in closed position of the valve, connects two electrodes 51 configured to actuate the vacuum pump. A weak spiral spring 52 (FIG. 6*b*) is mounted between the magnet and the bolt having the task of assisting the valve's opening upon the vacuum attaining the required level.

FIG. 6*b* shows the valve in open position with air flow shown in the form of arrows. It is reiterated that entry of outside air is within a fraction of a second creating the shock effect required for closing the jars.

It will be understood that only a few examples of the shape of the platform, the cover and the compartment have been shown, and that there are untold possibilities to vary them. As an example, the platform may be square to serve as a cover of a rectangular compartment. On the other hand, the cover may be hemispherical which will allow a relatively thin walled construction to withstand the outside pressure. The cover material may be glass, plastics or metal, to suit every one's taste.

I claim:

1. A vacuum apparatus for evacuating and hermetically closing containers filled with foodstuff or other products, comprising:

a vacuum chamber adapted to receive at least one container, the at least one container having an opening and a lid loosely placed onto the opening, said vacuum chamber being hermetically closable after receiving the at least one container;

a vacuum pump driven by an electric motor, said vacuum pump having a suction port connected to said vacuum chamber and a delivery port connected to the atmosphere;

a valve which is automatically openable at a predesignated vacuum pressure within the vacuum chamber, the automatically openable valve fluidly coupling said vacuum chamber with the atmosphere, said valve being manually closable to thereby interrupt the fluid coupling between said vacuum chamber and the atmosphere, wherein said valve has an upstream end open to the atmosphere and a downstream end communicating with said vacuum chamber, said valve comprising an adjustable mechanism adapted to hold said valve in a closed position until a predesignated vacuum level has been attained, said adjustable mechanism comprising a permanent magnet positioned at the upstream end and adapted to magnetically attract a magnetically attractable body attached to the upstream end of said valve body, adjustment of the magnetic attracting force being made by changing the distance between said magnet and said magnetically attractable body by axial displacement of said magnet to automatically open said valve in response to said predesignated pressure;

an electric power supply; and an electric circuit coupling said electric power supply to said pump motor for actuating said pump motor responsive to a closing motion of said valve, and for interrupting actuation of said pump motor responsive to an opening motion of said valve, thereby stopping the operation of said vacuum pump when said valve is opened.

2. The apparatus of claim 1, wherein said vacuum chamber comprises a platform, and a hollow, removable, pressure-resistant cover placed onto said platform in hermetic closure effected by a gasket positioned between said cover and said platform, and wherein said vacuum pump and said valve are connected to said vacuum chamber via ports in said platform.

3. The apparatus of claim 1, wherein said valve further comprises:

an oblong, hollow casing having an annular valve seat close to the upstream end thereof and a port in a wall thereof for pipe connection to said vacuum chamber, and a valve body having an outer diameter coextensive with said annular valve seat, said valve body being mounted on a valve stem which protrudes out of the downstream end of said casing, said valve body being positioned downstream of said valve seat in an open condition and is adapted to be manually moved into said annular valve seat by a push onto the protruding downstream end of said valve stem.

4. The apparatus of claim 3, wherein a conductive disk is attached to the upstream end of said valve body and which is operable to close, in a closed position of said valve, an electric circuit to said pump motor by contacting two electrodes which are insulatingly mounted at the upstream end of said casing.

5. The apparatus of claim 1, wherein said vacuum pump, said valve, piping for the valve and said electric circuit are enclosed in a compartment communicating with the atmosphere and with said vacuum chamber.

6. The apparatus of claim 2, wherein said platform is substantially planar and is horizontally positioned.

7. The vacuum apparatus of claim 2, wherein said gasket comprises a layer of a resilient material covering said platform.

8. The apparatus of claim 2, wherein said cover is of substantially hemispherical shape.

9. The apparatus of claim 2, wherein said cover is of substantially cylindrical shape.

10. The apparatus of claim 2, wherein said cover is substantially bell-shaped.

11. The apparatus of claim 2, wherein said gasket is provided along a lower edge of said cover.

12. The apparatus of claim 5, wherein said compartment is positioned underneath said platform.

13. The apparatus of claim 5, wherein said compartment is positioned on a side of said platform and is connected thereto by piping.

14. The apparatus of claim 12, wherein said compartment is generally box-shaped, and wherein said platform forms a cover of said compartment.

15. The apparatus of claim 12, wherein said compartment is substantially cylindrical, and wherein said platform forms a cover of said compartment.

16. The apparatus of claim 5, wherein said vacuum chamber comprises a cylindrical member firmly attached to said platform, and wherein a removable gasketed cover closes a top opening of said cylindrical member.

17. The apparatus of claim 7, wherein said gasket comprises a rubber sheeting.

18. The apparatus of claim 3, wherein said magnetically attractable disk is a steel body.

19. The apparatus of claim 3, wherein a member is attached to said valve body, said member being operable to close when said valve is in said closed position, an electric circuit to electrically actuate said pump when said valve is in said closed position.

* * * * *